US005988532A

United States Patent [19]

Alt et al.

[11] Patent Number: 5,988,532

[45] **Date of Patent: *Nov. 23, 1999**

[54] VALVE NOZZLE

[75] Inventors: Norbert Alt; Michael Blaich; Guenter Guerich; Karl-Joachim Schmuecker, all of Aachen, Germany

[73] Assignee: FEV Motorentechnik GmbH & Co., Aachen, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/737,681

[22] PCT Filed: Mar. 11, 1996

[86] PCT No.: PCT/EP96/01032

§ 371 Date: Nov. 21, 1996

§ 102(e) Date: Nov. 21, 1996

[87] PCT Pub. No.: WO96/29514

PCT Pub. Date: Sep. 26, 1996

[30] Foreign Application Priority Data

Mar. 23, 1995 [DE] Germany ..... 295 04 898 U

[51] Int. Cl.[6] ..... F23D 14/60

[52] U.S. Cl. ..... 239/414; 239/416.4; 239/424.5; 239/533.93; 137/898; 137/870

[58] Field of Search ..... 239/407, 513, 239/415, 416, 416.2, 416.4, 416.5, 417, 424.5, 533.2, 533.9, 414

[56] References Cited

U.S. PATENT DOCUMENTS

| | | | |
|---|---|---|---|
| 2,977,988 | 4/1961 | Drobilits et al. | 137/605 X |
| 4,040,569 | 8/1977 | Knapp . | |
| 4,266,727 | 5/1981 | Happel et al. | 239/416.4 X |
| 4,714,198 | 12/1987 | Savkar | 239/415 X |
| 4,801,092 | 1/1989 | Webber et al. | 239/424.5 X |
| 4,834,291 | 5/1989 | Kollmann | 239/415 X |
| 4,958,771 | 9/1990 | Klomp . | |
| 5,353,991 | 10/1994 | De Nagel et al. | 137/870 X |
| 5,400,970 | 3/1995 | Alt et al. . | |
| 5,982,902 | 1/1991 | Knapp et al. | 239/124 X |

FOREIGN PATENT DOCUMENTS

| | | | |
|---|---|---|---|
| 0384473 | 8/1990 | European Pat. Off. . | |
| 0599168 | 6/1994 | European Pat. Off. . | |
| 1933489 | 3/1970 | Germany . | |
| 876179 | 11/1981 | U.S.S.R. | 239/424.5 |
| 2150978 | 7/1985 | United Kingdom | 239/400 |

*Primary Examiner*—Kevin Weldon
*Attorney, Agent, or Firm*—Venable; George H. Spencer; Ashley J. Wells

[57] ABSTRACT

A valve nozzle for introducing a flowable liquid into a mixing chamber through which flows a gas includes a nozzle head having defined therein the mixing chamber and having a gas delivery conduit which communicates with the mixing chamber, the mixing chamber having at least one nozzle opening through which a mixture of the gas and the flowable liquid pass from the nozzle head; driving device for opening and closing the at least one nozzle opening; closing spring connected to the driving device; an actuating device connected to the closing spring; a closure body which is disposed on the outflow side of the at least one nozzle opening, which is supported on the actuating device, and which is axially movable; a distribution chamber which discharges into the mixing chamber and has a valve seat for the closure body so that the interstice between the valve seat and the closure body, in an open position of the closure body, forms the at least one nozzle opening; a delivery conduit for the flowable liquid which terminates in a calibrated inlet bore that discharges into the distribution chamber.

15 Claims, 4 Drawing Sheets

VALVE NOZZLE

BACKGROUND OF THE INVENTION

1. Field of the Invention

The invention relates to a valve nozzle for introducing a flowable medium into a mixing chamber, which nozzle is provided with a delivery conduit with which at least one nozzle opening in a nozzle head is associated and which nozzle has an axially movable closure body, which is disposed on the outflow side of the nozzle opening and is supported on an actuating means that is connected to a closing spring and a driving means.

2. Description of the Related Art

Valve nozzles of this kind, as are needed for instance for fuel injection valves, are known for instance in the conception shown in German Patent Disclosure DE-A 19 33 489 with a closure body located on the inside, and in which nozzles there is a closure body disposed between the delivery conduit and the nozzle opening in the interior of the nozzle head, so that between the valve seat for the closure body on the one hand and the nozzle opening on the other, a relatively large residual chamber remains, with the result that such injection valves dribble after injection.

From European Patent Disclosure EP-A 0 599 168, a device for combined blow-injection of fuel and air is known, in which a plurality of nozzle openings for the delivery of fuel, which are closable via a central closure body, discharge into a mixing chamber formed by an air conduit. The air conduit in turn is likewise closable via a central, second closure body, which cooperates with the first closure body for the nozzle openings. Not only is the production cost high, but the two closure bodies also have a relatively large mass which, given the mass forces to be controlled, demands considerable actuation forces both for the closing spring and for the driving means, such as an adjusting magnet, if short opening times and a high actuation frequency are to be attained.

With this last apparatus as its point of departure, the object of the invention is to create a valve nozzle of the type referred to at the outset which is designed more favorably with respect to manufacture and the mass forces to be controlled.

SUMMARY OF THE INVENTION

According to the invention, this object is attained in that the delivery conduit terminates, on its end toward the mixing chamber, in a calibrated inlet bore that discharges into a widening distribution chamber; that the distribution chamber discharges into the mixing chamber and has an encompassing valve seat for the closure body; and that the interstice between the valve seat and the circumferential contour of the closure body, in the opening position of the closure body, forms the nozzle opening. This arrangement has the advantage that the closure body can be made quite small, so that it has less mass. Since the compressive force exerted by the medium on the closure body is defined by the pilot pressure of the medium, and by the area of the closure body defined by the valve seat, which can be kept quite small, only a slightly greater closing force is needed for the closure and can be brought to bear by the closing spring. For the opening operation, the driving means need merely overcome the closing force of the spring, while the opening of the closure body is accomplished automatically via the pilot pressure of the medium to be introduced. The quantity of flowable medium to be introduced is determined here via the dimensions of the calibrated inlet bore and the opening time. Since the actual nozzle opening that discharges into the mixing chamber is formed by the interstice between the valve seat and the circumferential contour of the closure body in the opening position, dribbling after injection is avoided, since the incoming flow is cut off immediately upon the arrival of the closure body at the valve seat. By means of the surface of the closure body oriented toward the calibrated inlet bore and by means of the shaping of the distribution chamber, influence can now be exerted on the "spray pattern", and a widely fanned-out, fine distribution of the medium upon its introduction into the mixing chamber is possible.

In a suitable feature of the invention, it is proposed that adjoining the valve seat, the distribution chamber has a wall which is embodied as a guide face for the closure body, and that the free peripheral contour of the distribution chamber oriented toward the mixing chamber, on the one hand, and the circumferential contour of the closure body oriented toward the distribution chamber, on the other, forms the nozzle opening in the opening position of the closure body. By means of a corresponding wall geometry, combined with the geometry of the closure body, it is possible to vary the "incoming stream direction" of the medium to be introduced.

In an especially advantageous feature of the invention it is provided that the closure body is supported on the actuating means via a retaining spring, whose free spring travel a is shorter than the total stroke b of the actuating means. This arrangement is especially advantageous whenever a plurality of closure bodies are braced via one actuating means. By means of the additional retaining spring, it is advantageously possible to compensate for any production variations. If the actuating means is moved for the opening operation, then the closure body remains in its closing position until the stroke of the actuating means corresponds to the predetermined free spring travel of the retaining spring. Once the total stroke has been executed, the closure body is no longer loaded by the retaining spring, and thus the closure body rises from the valve seat in response to the pressure of the medium and uncovers the calibrate inlet bore.

In a suitable feature of the invention it is provided that the closure body, in the region between the valve seat and the peripheral contour of the distribution chamber, has a varying cross-sectional diameter. In accordance with the desired stream pattern, the cross-sectional diameter can increase, as is the case with a conical or spherical shape, for instance. However, the cross-sectional diameter may also decrease, as is conceivable for instance for a closure body in the shape of a double cone, barrel, or again a sphere. Depending on the given conditions, the closure body may also have a different body cross section from the three-dimensional shapes given above.

In the case of a distribution chamber whose wall largely surrounds the closure body and guides it, it may be expedient in a further feature of the invention that the wall of the distribution chamber, at least in its region bordering on the free peripheral contour, has at least one groovelike recess that opens into the mixing chamber. Given a suitable design of the grooves, it is possible that even in the opening position, the closure body rests practically tightly with its circumferential contour over wide regions of the wall of the distribution chamber, so that the flowable medium can pass over into the mixing chamber only through the grooves. The option then exists, by means of a helical course, of generating a kind of swirl effect.

In an especially advantageous feature of the invention it is provided that the retaining spring is embodied as a spiral spring, which is connected by one edge to the actuating means and with the other edge engages the closure body from underneath. Such a spiral spring, for instance in the form of a leaf spring, requires only little height for installation and can be manufactured with great precision. The embodiment of the retaining spring as a spiral spring is especially advantageous if a plurality of closure bodies are retained with one actuating means. In that case, the spiral spring may be embodied in the manner of a cup spring. The limitation of the spring travel of the retaining spring can be accomplished then in a simple manner by fastening the spiral spring loosely, by its edge toward the actuating means, thus defining a corresponding free travel that allows the free opening of the closure body.

If two or more nozzle openings are to be provided on one nozzle head, then instead of an embodiment in which at least two inlet conduits are provided, which each, on their end toward the mixing chamber, have a distribution chamber with a valve seat face and a closure body, it is provided in another feature of the invention that at least two calibrated inlet bores are disposed in the nozzle head, which communicate with the delivery conduit via an annular chamber, and which each discharge in one distribution chamber provided with a closure body, and that the closure bodies are supported on the actuating means. In all cases, it is expedient if the distribution chambers are disposed distributed in the circumferential direction relative to the axis of motion of the actuating means, preferably being distributed rotationally symmetrically to the axis of motion, in the nozzle head.

In a preferred embodiment for use as a fuel injection valve, it is provided according to the invention that the mixing chamber is embodied as a flow conduit, which communicates with an inflow chamber for a second flowable medium, and which is defined on one side by the nozzle head and on the other by a counterpart face on the actuating means, and which discharges into a work chamber. In this arrangement, the liquid medium, such as fuel, is delivered as the first flowable medium through the closable nozzle openings, while air is delivered through the flow conduit as the second flowable medium, so that the liquid medium, such as fuel, is introduced as a fog, mixed with air, into the work chamber. The particular advantage is also that after the closure of the nozzle openings, the quantities of liquid still adhering to the surface of the closure body are flushed away by the air moving past, and the liquid is thus introduced into the work chamber in the intended metered quantity.

In a further advantageous feature of the invention, it is provided that the region of the peripheral contour of the nozzle head oriented toward the work chamber, on the one hand, and the counterpart face on the actuating means, on the other, are embodied as sealing faces and define an inflow opening in the open position of the nozzle valve. This arrangement has the advantage that first, the closure bodies form nozzle valves for the one medium, and second, a closable valve for the second medium is formed via the peripheral contour of the nozzle head and of the actuating means. In such a nozzle valve, in which the closure bodies are supported via retaining springs with a limited spring travel, the advantage is attained here that at the beginning of the work stroke of the actuating means, first the flow conduit for the air is opened, and only then are the closure bodies opened, so that the liquid is injected into the already inflowing air. In the closing operation, the delivery of liquid is terminated first, and only after that, after a certain time lag, is the delivery of air ended, so that any residual liquid components in the work chamber are flushed out before the delivery of air is terminated as well.

BRIEF DESCRIPTION OF THE DRAWINGS

The invention will be described in further detail in conjunction with schematic drawings of exemplary embodiments. Shown are.

DESCRIPTION OF THE PREFERRED EMBODIMENTS

Figures 1, 2:
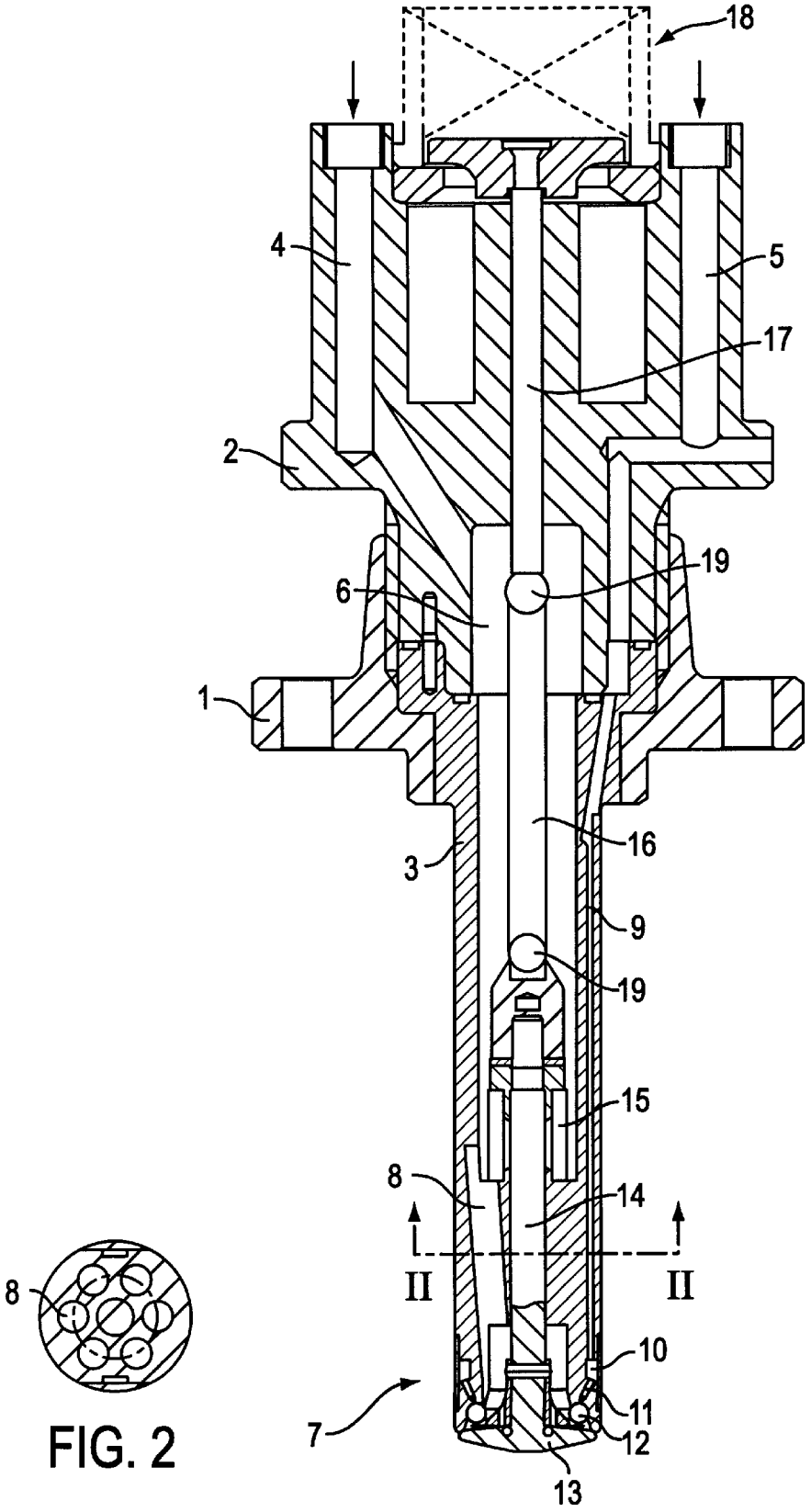
FIG. 1, in a longitudinal section on an enlarged scale, a valve nozzle embodied as a fuel injection valve.
FIG. 2, a section taken along the line II—II of FIG. 1.

The injection valve shown in a longitudinal section in FIG. 1 has a securing flange 1, with which a supply line head 2 and a nozzle holder 3 are firmly joined. Provided in the supply line head 2 are a first supply line 4, which communicates with a compressed air source, and a second supply line 5, which communicates with a pressurized fuel supply. The air supply line 4 discharges into a collection chamber 6 in the nozzle holder 3, which in the region of the nozzle head 7 changes over into a plurality of air delivery conduits 8, which are arranged concentrically with the center axis of the nozzle holder 3, as can be seen from the sectional view of FIG. 2. A fuel delivery conduit 9, which discharges into an annular chamber 10 in the region of the nozzle head 7, is associated with the fuel supply line 5 in the region of the nozzle holder 3. Calibrated delivery bores 11, corresponding to the provided number of nozzle openings, are associated with the annular chamber 10 and are closable on their outflow side via closure bodies 12. The closure bodies 12 are supported essentially on an actuating means 13, which is connected via a guide shaft 14 to a closing spring 15, which is embodied as a compression spring and in the position of repose keeps the closure bodies 12 in the closing position.

The guide shaft 14 is connected via a tubular thrust rod 16 to a guide shaft 17, which is part of a driving means 18, such as an electromagnetic actuator. The free ends of the guide shafts 14 and 17 have face-end recesses in which ball bodies 19 that hold the thrust rod 16 are supported. As a result of the tubular thrust rod 16, a considerable reduction in mass is attained, and because of the ball bodies 19, errors of alignment between the guide shaft 14 and the guide shaft 17 can be compensated for.

Figure 3:
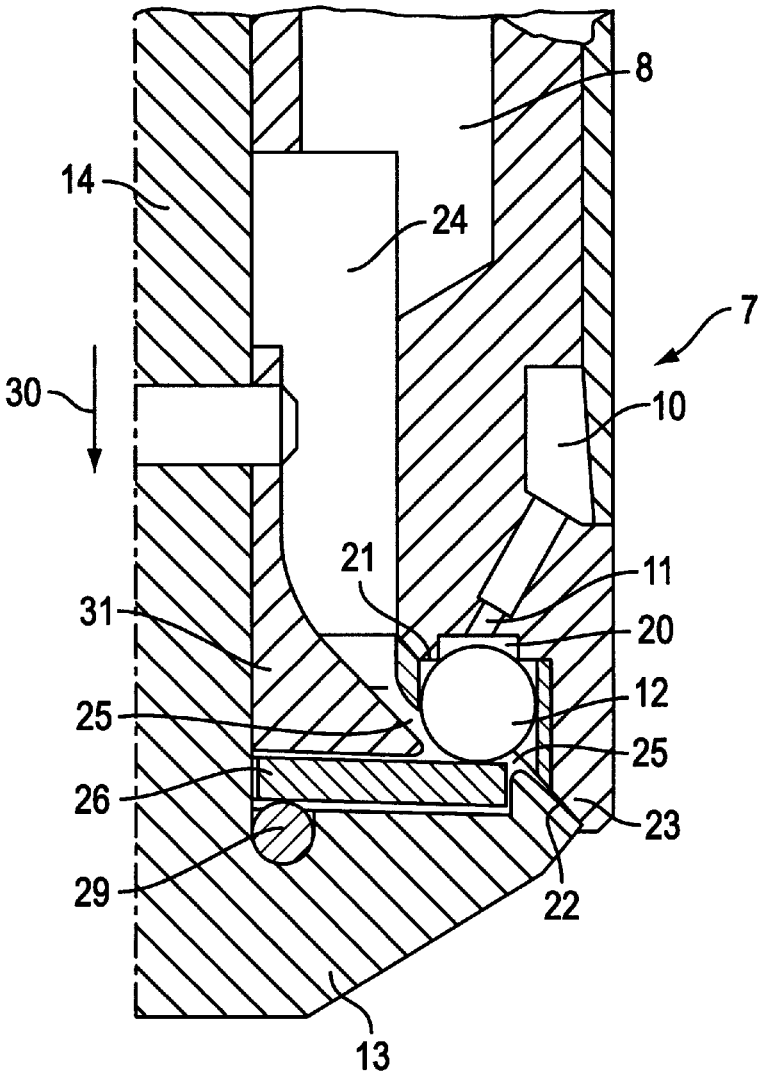
FIG. 3, on a larger scale, structural details of the nozzle head of the valve nozzle of FIG. 1, in a longitudinal section.

The layout of the valve nozzle can be seen on larger scale in FIG. 3. The calibrated inlet bore 11 discharges into a cylindrical distribution chamber 20, which is provided with a valve seat 21 on which the closure body 12, embodied as a ball, rests.

The actuating means 13 has a flangelike head, which on its outer edge has a counterpart face 22, embodied as a sealing face, which is embodied with a corresponding face 23 on the free end of the nozzle head 7 as a sealing face.

FIG. 3 shows this arrangement in the closing position.

Inside the nozzle head 7, the air delivery conduits 8 discharge into an inflow chamber 24, which merges with the conically shaped faces 22 and 23; the interstice between the two faces 22 and 23, in the opening position, form a flow conduit 25 for the air from the inflow chamber 24.

Figure 4:
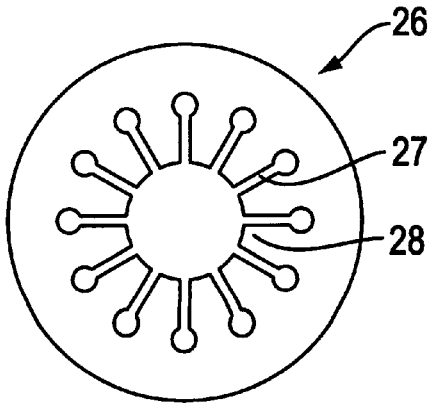
FIG. 4, a plan view on a retaining spring.

Disposed on the flangelike head of the actuating means 13 is a spiral spring 26, in the form of a slit cup spring, whose shape can be seen from FIG. 4. The spiral spring 26 is closed on its outer edge, while toward the inner edge there are corresponding fingers 28 divided by slits 27. By way of the fingers 28, the spiral spring 26 is supported on an abutment 29 in the form of a hardened steel ring, which is connected to the actuating means 13.

In the closing position shown in FIG. 3, the closure body 12 is pressed onto the valve seat 21 by the spiral spring 26, so that the connection with the calibrated inlet bore is closed. At the same time, the two faces 22 and 23 rest sealingly on one another, so that the flow conduit 25 is closed as well. By the arrangement of the spiral spring 26, it is assured that even manufacturing inaccuracies are compensated for, so that both the inlet bore 11 and the flow conduit 25 are tightly closed via the faces 22 and 23 resting one on the other. The closing force is brought to bear by the closing spring 15. If the actuating means 13 is now moved downward in the direction of the arrow 30 via the driving means 18, then first the flow conduit 25 opens, so that air can already flow out of the inflow chamber 24. As soon as the only limitedly deformed spiral spring 26 has relaxed completely, it is carried along by a counterpart holder 31 connected to the guide shaft 14, so that the support is taken away from the closure body 12. The liquid pressure prevailing at the inlet bore 11 lifts the closure body 12 from the valve seat 21, so that the liquid can flow around the closure body 12 and exit into the flow conduit 25, where it is entrained by the air.

As FIG. 3 shows, between the wall of the distribution chamber 20 and the circumference of the closure body 12 in the open position, a corresponding gap arises that forms the nozzle opening, through which the liquid can enter into the mixing chamber formed by the flow conduit 25.

If the force of the driving means 18 is lessened, the closing spring 15 pulls the actuating means 13 back into the closing position. First, with the gap still open between the faces 22 and 23, the closure body 12 is pressed onto the valve seat 21 via the spiral spring 26, and thus the inward flow of liquid is prevented. However, the air continues to flow through the flow conduit 25 and flushes even residual quantities of liquid away with the other, while simultaneously mixing the liquid and air, into the work chamber that surrounds the injection valve.

Figure 5:
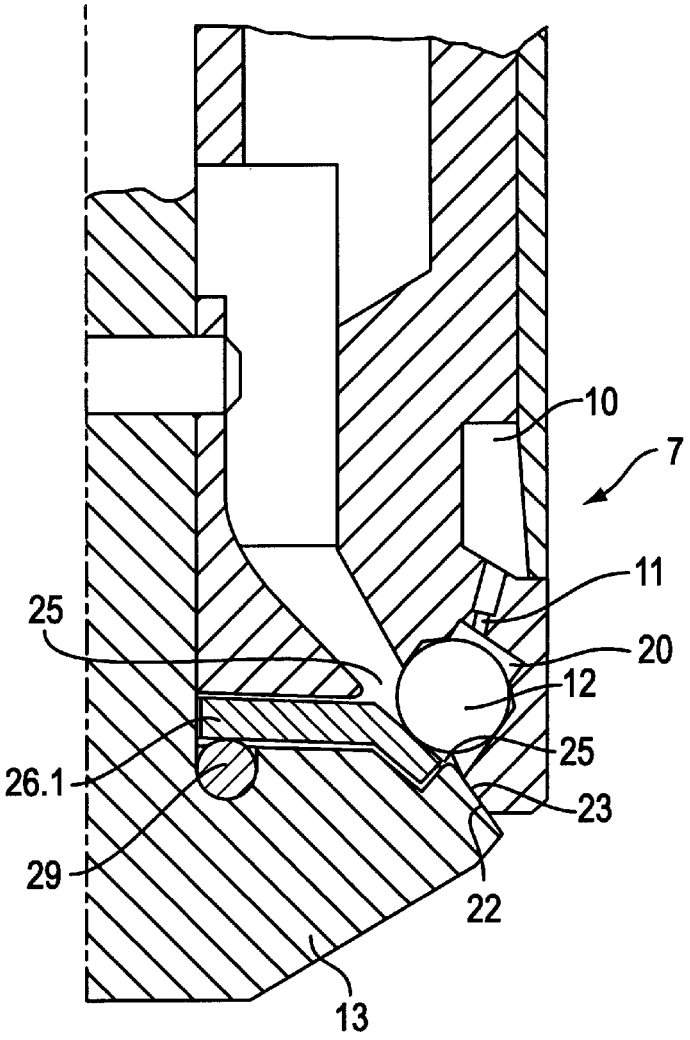
FIG. 5, an enlarged longitudinal section through another embodiment of the nozzle head.
Figure 6:
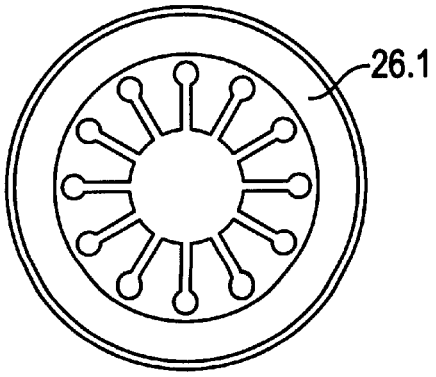
FIG. 6, a plan view of the retaining spring of the embodiment of FIG. 5.

While in the embodiment of FIG. 3 the axes of the individual distribution chambers 20 extend rotationally symmetrically and parallel to the axis of motion of the actuating means 13, in the embodiment of FIG. 5, which in its basic layout otherwise corresponds to the embodiment of FIG. 3, the axes of the individual distribution chambers 20 are oriented extending at an angle to the axis of the actuating means 13. While in the embodiment of FIG. 3 the distribution chamber 20, with its walls that guide the closure body 12, is formed by a corresponding insert part, which is inserted as a separate component, for instance by hard soldering or the like, into the nozzle head 7, the arrangement of FIG. 5 allows the machining of the distribution chamber 20 directly into the material of the nozzle head 7. Accordingly, the spiral spring 26.1 must be embodied somewhat differently as well. While in the embodiment of FIG. 3 the spiral spring 26 is embodied as a flat disk, the spiral spring 26.1 with an otherwise identical embodiment, has a shell form, in which the outer edge is angled, so that the support face formed by the outer edge is oriented approximately at right angles to the axis of motion of the closure body 12. The advantage of the embodiment of FIG. 5 is also that the flow conduit 27 can be embodied as tapering more slenderly, so that in this case the air and liquid mixture to be introduced, while depending on the injection conditions may also be present in the form of vapor, is introduced more steeply into the work chamber relative to the axis of the valve nozzle.

The layout of the embodiment of FIG. 5 otherwise corresponds to the layout and mode of operation of the embodiment described in conjunction with FIGS. 1 and 3.

Figure 8:
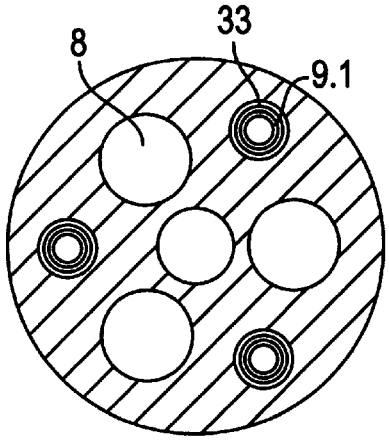
FIG. 8, a cross section taken along the line VIII—VIII of FIG. 7.
Figure 7:
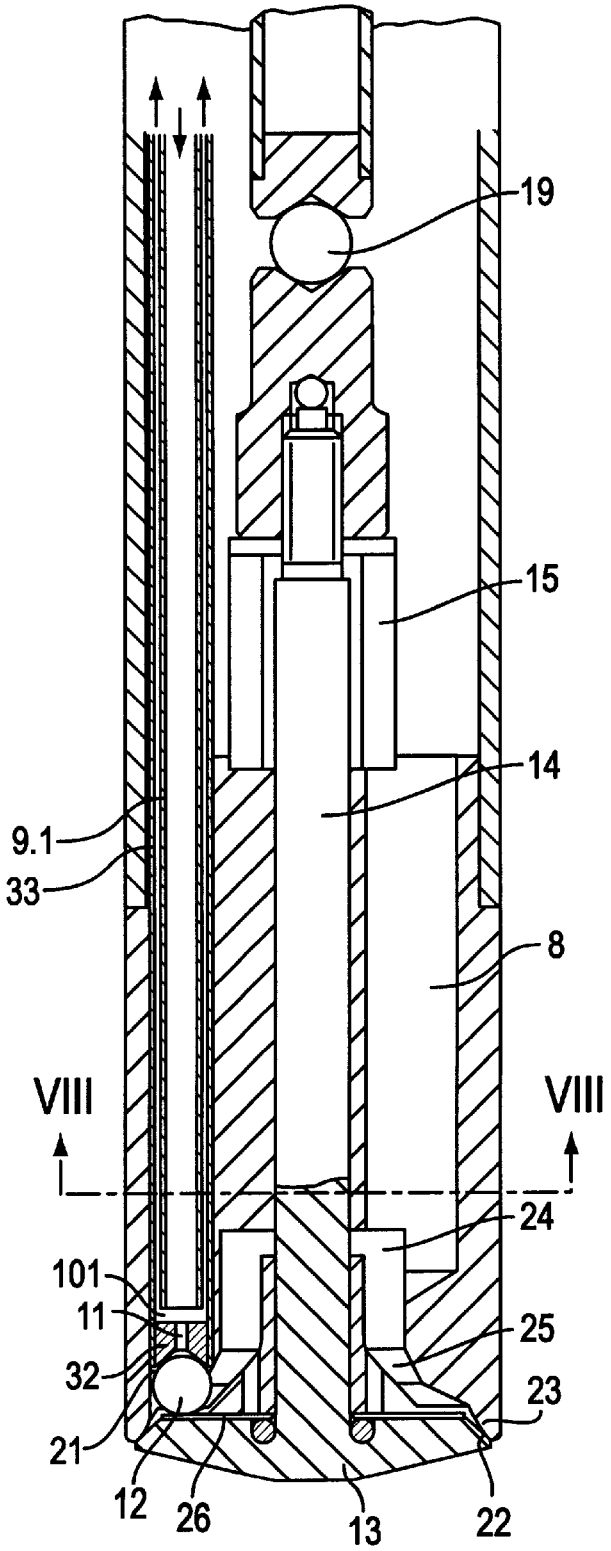
FIG. 7, a further embodiment for a valve nozzle, on a larger scale and in a longitudinal section.

The longitudinal section of FIG. 7 and a cross section of FIG. 8 show an embodiment that is modified compared with FIGS. 1, 3 and 5. Since the embodiment of FIG. 7 in its basic layout corresponds to the embodiments described above, identical components are provided with the same reference numerals, so that with respect to the layout and mode of operation, reference may be made to the description above.

In the embodiment of FIG. 7, the nozzle head 7.1 has a plurality of axially parallel air delivery conduits 8, which discharge into a corresponding inflow chamber 24. The nozzle head 7.1 is again provided in the peripheral region with a face 23, with which a counterpart face 22 on the head of the actuating means 13 is associated, the counterpart face acting as both a sealing face and a wall face for a flow conduit 25, when the actuating means is in the opening position.

The essential distinction of this embodiment is that the fuel delivery conduit 9.1, in the form of a tube, is lengthened into the valve region of the nozzle head 7.1, and that the free end of this tube is itself embodied as a valve. To that end, an insert piece 32, which is provided with the calibrated delivery bore 11, is inserted into the tube. The free edge of the tube 9.1 then forms the valve seat 21, on which the closure body 12 embodied as a ball rests. The closure body 12 is again supported via a retaining spring 26, embodied as a spiral spring, on the actuating means 13, which in turn is kept in its closing position via a closing spring 15. Once again, the free spring travel is shorter than the total stroke of the actuating means 13, so that in the closing position the head of the actuating means 13, via its counterpart 22, rests sealingly on the face 23, while the closure body 12 is pressed against the valve seat 21 via the retaining spring 26.

The tube 9.1 serving as a fuel delivery conduit then communicates directly with the fuel supply via an annular chamber, not shown in further detail here.

Since in many applications such injection nozzles are exposed to high temperatures, the arrangement is advantageously made such that the liquid medium to be injected is delivered via the delivery conduit 9 as far as an overflow chamber upstream of the calibrated inlet bore 11, and is entirely removed from this overflow chamber via a return line, regardless of the opening or closing state of the closure body 12. In this way, the tip of a nozzle can be cooled via the liquid medium to be injected, and at the same time the formation of vapor bubbles can be prevented, or vapor bubbles that develop can be removed.

In the design shown in FIG. 1, one or more return lines would then have to be connected to the annular chamber 10.

In the embodiment shown in FIG. 7, the arrangement is chosen such that the return line 33 is provided coaxially with the delivery conduit 9.1, and the space between the end of the delivery conduit 9.1 and the beginning of the calibrating inlet bore 11 acts as an overflow chamber 10.1. Structurally, the arrangement here is made such that the return line 33 carries the insert piece 32, and its free end edge, as can be seen from the drawing, is embodied as a valve seat 21.

What is claimed is:

1. A valve nozzle for introducing a flowable liquid into a mixing chamber through which flows a gas, the valve nozzle comprising:

a nozzle head having defined therein the mixing chamber and having a gas delivery conduit which communicates with the mixing chamber, the mixing chamber having at least one nozzle opening through which a mixture of the gas and the flowable liquid pass from the nozzle head;

driving means for opening and closing the at least one nozzle opening;

closing spring connected to the driving means;

an actuating means connected to the closing spring;

a closure body which is disposed on the outflow side of the at least one nozzle opening, which is supported on the actuating means, and which is axially movable;

a distribution chamber which discharges into the mixing chamber and has a valve seat for the closure body so that the interstice between the valve seat and the closure body, in an open position of the closure body, forms the at least one nozzle opening;

a delivery conduit for the flowable liquid which terminates in a calibrated inlet bore that discharges into the distribution chamber.

2. The valve nozzle according to claim 1, wherein the distribution chamber has a peripheral zone which is oriented toward the mixing chamber, wherein the closure body has a circular portion which is oriented toward the distribution chamber, wherein the nozzle opening in the open position of the closure body is formed by the peripheral zone of the distribution chamber and the circular portion of the closure body, wherein the valve seat has a face, and wherein the distribution chamber has a wall adjoining the face of the valve seat, which wall is a guide face for the closure body.

3. The valve nozzle according to claim 1, wherein the distribution chamber has a peripheral zone which is oriented toward the mixing chamber, wherein the valve seat has a face, and wherein the closure body has a varying cross-sectional diameter in the region between the face of the valve seat and the peripheral zone of the distribution chamber.

4. The valve nozzle according to claim 1, wherein the closure body has a circular cross section.

5. The valve nozzle according to claim 1, wherein the distribution chamber has a wall and a peripheral zone which is oriented toward the mixing chamber, and wherein the wall of the distribution chamber, at least in the region thereof which borders on the peripheral zone, has at least one recess that opens into the mixing chamber.

6. The valve nozzle according to claim 1, wherein a plurality of closure bodies are provided, and wherein the delivery conduit for the flowable liquid includes at least two delivery conduits, each delivery conduit terminating in a calibrated inlet bore that discharges into a distribution chamber having a valve seat for a respective closure body.

7. The valve nozzle according to claim 1, wherein the actuating means has an axis of motion, and wherein a plurality of distribution chambers are provided and are circumferentially distributed in the nozzle head with reference to the axis of motion of the actuating means.

8. The valve nozzle according to claim 1, wherein the actuating means has an axis of motion, and wherein a plurality of distribution chambers are provided and are disposed symmetrically in the nozzle head with respect to the axis of motion of the actuating means.

9. The valve nozzle according to claim 1, wherein the nozzle head has a face, wherein the actuating means has a counterpart face which opposes the face of the nozzle head, wherein the at least one outlet of the mixing chamber is defined on one side by the face of the nozzle head and on another side by the counterpart face of the actuating means, and wherein the mixing chamber discharges into a work chamber.

10. The valve nozzle according to claim 9, wherein the nozzle head has a peripheral zone at least a portion of which is oriented toward the work chamber, wherein the portion of the peripheral zone of the nozzle head which is oriented toward the work chamber and the counterpart face on the actuating means are sealing faces and define an inflow opening in the open position of the nozzle valve.

11. The valve nozzle according to claim 1, wherein the driving means has a tubular thrust rod, and wherein the actuating means has a guide shaft which is connected to the tubular thrust rod of the driving means.

12. The valve nozzle according to claim 1, further comprising a return line for the flowable liquid, wherein the flowable liquid in the delivery conduit has a flow direction, and wherein an overflow chamber is provided upstream, in the flow direction, of the calibrated inlet bore into which the delivery conduit for the flowable liquid discharges and which communicates with the return line.

13. A valve nozzle for introducing a flowable liquid into a mixing chamber through which flows a gas, the valve nozzle comprising:

a nozzle head having defined therein the mixing chamber and having at least one gas delivery conduit which communicates with the mixing chamber, the mixing chamber having at least one nozzle opening through which a mixture of the gas and the flowable liquid pass from the nozzle head;

driving means for opening and closing the at least one nozzle opening;

closing spring connected to the driving means;

an actuating means connected to the closing spring;

a closure body which is disposed on the outflow side of the at least one nozzle opening, which is supported on the actuating means, and which is axially movable;

a distribution chamber which discharges into the mixing chamber and has a valve seat for the closure body so that the interstice between the valve seat and the closure body, in an open position of the closure body, forms the at least one nozzle opening; and a delivery conduit for the flowable liquid which terminates in a calibrated inlet bore that discharges into the distribution chamber, wherein the actuating means has a total stroke, and wherein the closure body is supported on the actuating means via a retaining spring whose free spring travel is shorter than the total stroke of the actuating means.

14. The valve nozzle according to claim 13, wherein the retaining spring is a spiral spring which is connected by one edge to the actuating means and which engages the closure body from underneath by another edge.

15. A valve nozzle for introducing a flowable liquid into a mixing chamber through which flows a gas, the valve nozzle comprising:

a nozzle head having defined therein the mixing chamber and having a gas delivery conduit which communicates with the mixing chamber, the mixing chamber having at least one nozzle opening through which a mixture of the gas and the flowable liquid pass;

driving means for opening and closing the at least one nozzle opening;

closing spring connected to the driving means;

an actuating means connected to the closing spring;

a closure body which is disposed on the outflow side of the at least one nozzle opening, which is supported on the actuating means, and which is axially movable;

a distribution chamber which discharges into the mixing chamber and has a valve seat for the closure body so that the interstice between the valve seat and the closure body, in an open position of the closure body, forms the at least one nozzle opening; and a delivery conduit for the flowable liquid which terminates in a calibrated inlet bore that discharges into the distribution chamber, wherein a plurality of distribution chambers are provided, wherein a plurality of closure bodies are provided, wherein at least two calibrated inlet bores are provided which are disposed in the nozzle head, which communicate with the delivery conduit for the flowable liquid via an annular chamber, and which each discharge into one distribution chamber associated with one closure body.

* * * * *